US008807040B2

(12) United States Patent
Menefee, III

(10) Patent No.: US 8,807,040 B2
(45) Date of Patent: Aug. 19, 2014

(54) CARTRIDGE FOR MULTIPLEX LOAD

(76) Inventor: James Y. Menefee, III, Macon, GA (US)

( * ) Notice: Subject to any disclaimer, the term of this patent is extended or adjusted under 35 U.S.C. 154(b) by 0 days.

(21) Appl. No.: 13/542,344

(22) Filed: Jul. 5, 2012

(65) Prior Publication Data

US 2013/0008335 A1 Jan. 10, 2013

Related U.S. Application Data

(60) Provisional application No. 61/505,386, filed on Jul. 7, 2011.

(51) Int. Cl.

| | |
|---|---|
| ***F42B 5/03*** | (2006.01) |
| ***F42B 33/02*** | (2006.01) |
| ***F42B 7/10*** | (2006.01) |
| ***F42B 7/08*** | (2006.01) |
| ***F42B 7/04*** | (2006.01) |

(52) U.S. Cl.

CPC . *F42B 33/02* (2013.01); *F42B 7/10* (2013.01); *F42B 5/03* (2013.01); *F42B 7/08* (2013.01); *F42B 7/046* (2013.01)

USPC ..... 102/460

(58) Field of Classification Search

USPC ..... 102/460, 454, 448, 438, 430, 451, 461, 102/453, 452, 462; 86/11

See application file for complete search history.

(56) References Cited

U.S. PATENT DOCUMENTS

| | | | | | |
|---|---|---|---|---|---|
| 41,590 | A | * | 2/1864 | Allen | 102/460 |
| 151,327 | A | * | 5/1874 | Weldon | 102/454 |
| 157,793 | A | * | 12/1874 | Cochran | 102/453 |
| 873,347 | A | * | 12/1907 | Christie | 102/454 |
| 3,055,301 | A | | 9/1962 | Miller et al. | |
| 3,074,344 | A | * | 1/1963 | Pierre | 102/454 |
| 3,195,461 | A | * | 7/1965 | Freed | 102/457 |
| 3,233,546 | A | | 2/1966 | Foote et al. | |
| 3,285,174 | A | | 11/1966 | Moehlman et al. | |
| 3,599,568 | A | | 8/1971 | Shellnutt et al. | |
| 4,173,930 | A | | 11/1979 | Faires, Jr. | |
| 4,290,365 | A | | 9/1981 | Dreyer | |
| 4,441,400 | A | | 4/1984 | Sexton | |
| 4,679,505 | A | | 7/1987 | Reed | |
| 4,733,611 | A | * | 3/1988 | Janay et al. | 102/439 |
| 4,760,793 | A | | 8/1988 | Herring, III | |
| 4,779,535 | A | | 10/1988 | Maki | |
| 4,815,388 | A | | 3/1989 | Schluckebier et al. | |
| 4,864,934 | A | | 9/1989 | Theising | |

(Continued)

FOREIGN PATENT DOCUMENTS

| | | | |
|---|---|---|---|
| CA | 1045459 | A1 | 1/1979 |
| CA | 1262319 | A1 | 10/1989 |

(Continued)

*Primary Examiner* — Reginald Tillman, Jr.

(74) *Attorney, Agent, or Firm* — Sutherland Asbill & Brennan LLP

(57) ABSTRACT

This disclosure relates to cartridges, including shotshell cartridges, for launching multiplex projectile loads that contain different sizes or types of projectiles, and methods of loading the cartridges. In one aspect, for example, the present cartridges can contain an obturating component adjacent the cartridge propellant, a first payload adjacent the obturating component, a separating component adjacent the first payload, and a second payload adjacent the separating component. Shotshells of this configuration in which the first (aft) payload comprises birdshot and the second (forward) payload comprises buckshot are particularly useful.

19 Claims, 1 Drawing Sheet

(56) References Cited

U.S. PATENT DOCUMENTS

| | | | |
|---|---|---|---|
| 5,171,934 | A | 12/1992 | Moore |
| 5,471,931 | A | 12/1995 | Gardner |
| 5,631,441 | A | 5/1997 | Briere et al. |
| 5,837,927 | A | 11/1998 | Buenemann, Jr. |
| 6,202,561 | B1 | 3/2001 | Head et al. |
| 6,367,388 | B1 | 4/2002 | Billings |
| 6,393,992 | B1 | 5/2002 | Vasel et al. |
| 7,302,892 | B1 | 12/2007 | Meyer et al. |
| 8,171,849 | B2 | 5/2012 | Amick |
| 2010/0294158 | A1 | 11/2010 | Poore et al. |
| 2011/0017090 | A1 | 1/2011 | Menefee, III |
| 2011/0174186 | A1 | 7/2011 | Frank et al. |
| 2011/0185936 | A1 | 8/2011 | Richardson et al. |

FOREIGN PATENT DOCUMENTS

| | | | |
|---|---|---|---|
| CA | 2134665 | C | 11/1993 |
| GB | 1081747 | A | 8/1967 |
| WO | 2010025121 | A1 | 3/2010 |
| WO | 2011085279 | A2 | 7/2011 |

* cited by examiner

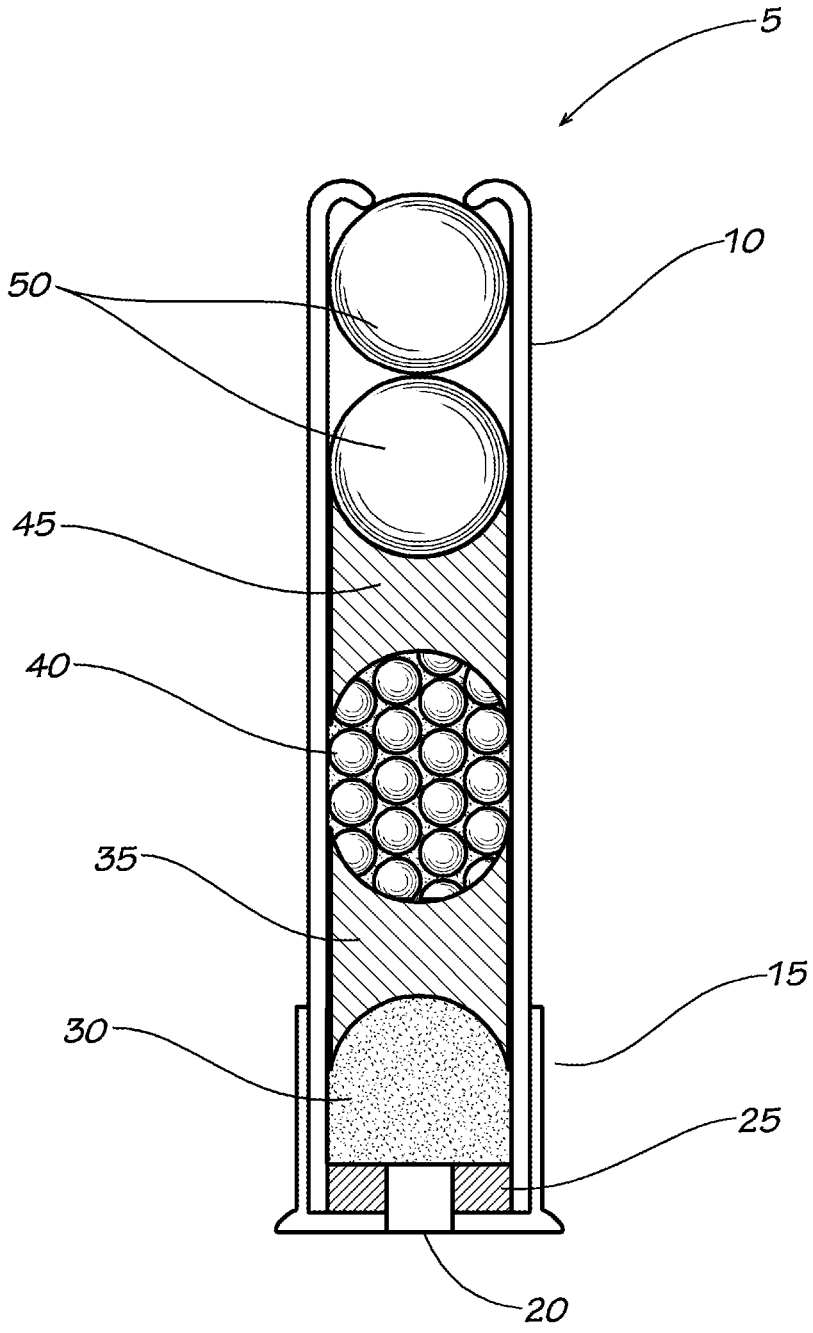
5
10
50
45
40
35
15
30
25
20

CARTRIDGE FOR MULTIPLEX LOAD

CROSS REFERENCE TO RELATED APPLICATIONS

This application claims the benefit of U.S. Provisional Application No. 61/505,386, filed Jul. 7, 2011, the disclosure of which is incorporated herein by reference in its entirety.

TECHNICAL FIELD OF THE INVENTION

This disclosure relates to cartridges for launching projectiles, including shotshell cartridges for launching payloads that contain different sizes of projectiles within a single cartridge.

BACKGROUND

Cartridge systems constitute extremely practical constructions and methods for deploying almost any payload or projectile downrange. Typical cartridge systems incorporate the desired payload, a propellant, and some priming composition all within a self-contained unit. Ammunition cartridges are prototypical of cartridge devices, although cartridge systems have been used to launch chemical, pyrotechnic, marker, tracer, signaling, non-lethal, explosive, smoke, and other payloads to exploit their specific function.

Shotshell cartridges are complex ammunition cartridge systems that require additional components beyond the nominal propellant, projectile, and primer in order to effectively launch the desired projectiles. For example, a shotshell "wad" is the general term applied to the collection of components in a shotshell other than the projectile(s), the propellant, and the primer, which is used for effective delivery of the projectiles. Shotshell wads may be designed for various functions such as providing a seal against expanding propellant gases, containing and stabilizing the projectile(s) for a desired distance downrange, and/or cushioning and barrel protection.

While several configurations of shotshell components have been described for delivering a selected shot downrange, particular difficulties may arise when a single shotshell contains more than one size of projectile. These special purpose loads have found many applications in cartridges designed for hunting particular game and for self-defense. However, conventional loading methods such as adding buffer the shot can undesirably increase chamber pressure and complicate the loading process. Therefore, there exists a need for new cartridge designs that can effectively deliver two or more different sizes of projectiles downrange that are relatively simple and cost effective. Such designs would preferably use components that do not require additional costly tooling requirements for their manufacture, and desirably would seek to avoid the complicated features that can prohibitively increase costs.

SUMMARY OF THE INVENTION

The present disclosure relates to cartridges for delivering payloads, particularly, shotshell cartridges for delivering projectile loads that contain more than one size of projectiles, and methods of loading the cartridges. The cartridges and methods of this disclosure are particularly useful for cartridges loaded with multiple sizes of projectiles. In this disclosure, projectile loads that contain different sizes or types of projectiles are termed "multiplex" loads. For example, "duplex" and "triplex" loads containing two or three different sizes or types of projectiles, respectively, are subject to the improved cartridge designs disclosed herein. However, the cartridges and methods of this disclosure are also useful when loading projectiles of the same or similar size, when it is desired to separate the entire payload into more than one projectile batch, for example, when the composition, hardness, and/or shape of the projectiles differ.

In one aspect, for example, cartridges according to this disclosure can constitute these so-called multiplex cartridges, and the subject cartridges can comprise:

a) a cartridge case having a fore end and an aft end and, the cartridge case comprising a primer situated at the aft end;
b) a propellant adjacent the primer;
c) an obturating component adjacent the propellant and a first payload adjacent the obturating component; and
d) a separating component adjacent the first payload and a second payload adjacent the separating component.

In this disclosure, reference may be made to the obturating component as the "first obturating component" and the separating component as the "second obturating component", merely to illustrate a preferred aspect in which both the obturating component and the separating component are selected from the same type of pre-formed gas seal, which has two different functions depending on its position within the cartridge. In the aft (bottom) of the cartridge, the first gas seal has primarily an obturating function, and in the fore (top) of the cartridge, the second gas seal has primarily a separating function. In another aspect, if so desired, the multiplex cartridge can further comprise a second separating component adjacent the second payload and a third payload adjacent the second separating component, to form a "triplex" load.

These and other aspects and embodiments of the disclosed cartridges and methods are described more fully in the detailed description and figure, further disclosure, and appended claims.

BRIEF DESCRIPTION OF THE FIGURE

FIG. 1 illustrates one embodiment of the multiplex shotshell loading of this disclosure in which the obturating component and the separating component are identical "H-wads", having relatively thick bodies and relatively thin lips or skirt. The first payload adjacent and forward the obturating component comprises birdshot, and the second payload adjacent and forward the separating component comprises buckshot.

DETAILED DESCRIPTION OF THE INVENTION

According to an aspect, this disclosure provides multiplex cartridges, comprising:

a) a cartridge case having a fore end and an aft end and, the cartridge case comprising a primer situated at the aft end;
b) a propellant adjacent the primer;
c) an obturating component adjacent the propellant and a first payload adjacent the obturating component; and
d) a separating component adjacent the first payload and a second payload adjacent the separating component.

According to aspects and embodiments of the disclosure, the different payloads of a single cartridge can be different sizes of shot, or different types according to some other characteristic (for example, chemical composition, shape, hardness) separated by a separating component, for example, a gas seal such as a pre-formed gas seal. Typically, multiplex cartridges can comprise a first payload and a second payload having different sizes projectiles, for example, in which first payload projectile is smaller than the second payload projectile, and they can be separated by a gas seal. Thus, tighter downrange patterns generally are obtained when the first (aft or bottom) payload comprises smaller (or alternatively less dense or lighter) shot, and the second (forward or top) payload comprises larger (or alternatively more dense or heavier) shot. More spread in the downrange patterns generally is obtained when the first payload comprises the larger (or more dense or heavier) shot and the second payload comprises smaller (or less dense or lighter) shot. In one aspect, a multiplex load of this disclosure can include buckshot projectiles and birdshot projectiles. Therefore, if tighter loads are sought, it is desirable to load the birdshot first (on bottom) and the buckshot second (on top) in the cartridge. However, these positions can be reversed if more dispersed patterns are desired.

Typically, both the obturating component, which functions primarily as a seal against hot propellant gases and the separating component, which functions primarily as a separation means between the different payloads without disrupting the pattern, are selected from a pre-formed gas seal. Particularly, suitable pre-formed gas seals are those that comprise a very stiff body or center portion that does not deform or substantially deform on firing. In one aspect, such a pre-formed gas seal has leading (forward) and aft (rearward) edges (the "skirt" or "lips") that are relatively thin so as to be deformable on firing. Therefore, even though material itself provides a stiff, inflexible gas seal body, the skirt or lips are sufficiently thin that they can deform from the expanding gases to a sufficient degree to obturate. Such a seal can be one designed for or comprising a material such as polymer for low temperature use, if desired.

In another aspect, the pre-formed seal that contains an inflexible gas seal body with a flexible skirt for obturation can be one in which the axial (fore-to-aft) length of the seal can be from about 45% to about 145% of its width; alternatively, from about 55% to about 140% of its width; alternatively, from about 65% to about 130% of its width; or alternatively, from about 75% to about 125% of its width. In some embodiments, the axial length of the pre-formed seal can have a (fore-to-aft) length from about 50% to about 100% of its width. Pre-formed gas seals which work well as both the obturating component and the separating component in a .410 multiplex load can be, for example, the type of "H-wad" produced by Remington Arms Company for their .410 buckshot loads. H-Wads are so-named for their generally H-shaped cross section resulting from the provision of a skirt or flange extending in both fore and aft directions from an imperforate transverse barrier or body portion. H-wads are typically molded from polyethylene and are symmetrical, having identical ends, which eliminates the need for orientation of the wads in automatic feeding machinery. When used in the .410 multiplex load disclosed herein, the particular H-wad gas seals that work well can have an axial (fore-to-aft) length-to-width ratio of about 1 to about 1.4; alternatively about 1.05 to about 1.35; alternatively about 1.10 to about 1.30; alternatively about 1.15 to about 1.25; or alternatively about 1.17 to about 1.23. For example, the Remington H-wad for .410 buckshot loads that works well in the .410 multiplex loads of this disclosure has an axial (fore-to-aft) length-to-width ratio of about 1.2.

In addition, at least one of the first payload, the second payload, and/or additional payloads can comprise at least one projectile selected from birdshot, buckshot, and slug projectiles. When loading "duplex" loads, the separating component divides and keeps separate the different projectile sizes or types. For example, one useful embodiment uses birdshot as the first (rearward or aft) projectiles and buckshot as the second (forward or fore) projectiles, and an H-wad separating component. This configuration contrasts with some duplex loads known in the art, which use no separation means between the different size payloads in the shotshell.

According to a further aspect, the obturating component and the separating component can be selected independently from a pre-formed gas seal and a wadless obturating medium. Examples of wadless obturating medium are found in U.S. Patent Application Publication Number 2011/0017090, which is incorporated herein by reference in its entirety. When one of the obturating component and the separating component is selected from a pre-formed gas seal, the pre-formed gas seal generally is of the type having thin and flexible skirts fore and aft, that is, the leading (forward) and aft (rearward) edges or "lips" are relatively flexible.

One advantageous loading provided herein is a multiplex cartridge according to claim 1, wherein the first payload comprises birdshot and the second payload comprises buckshot. The cartridges of this disclosure are applicable to any gauge shotshell (for example, .410, 28, 20, 16, 12, and 10 gauges) and use any size projectile. These cartridges are particularly advantageous in loading .410 gauge shotshells for loads designed for small game, personal defense loads, and the like. In this aspect, it is typical that the rearward, first payload comprise pellets of birdshot, which can be for example, Nos. 2, 3, 4, 5, 6, 7½, 8, or 9 shot, or sizes larger or smaller than these. It is also typical that the forward, second projectile comprises the pellets of buckshot that are aligned in "single file" within the .410 cartridge shell. For a .410 shotshell, No. 000 buckshot pellets work well. The cartridge typically comprises a roll crimp, as a roll crimp can be tightly secured against the resistance of the single, forward-most buckshot projectile. If desired, at least one additional wad may be employed, for example an overwad to secure the forward-most projectile. Overwads or star crimps would be typical in loads that comprise birdshot in the forward most position within the cartridge. Standard shot sizes and information can be found in Thomas J. Griffin, ed., *Shotshell Reloading Handbook,* 5$^{th}$ ed., Lyman Publications, Lyman Products Corporation, Middletown, Conn. (2007).

In a further aspect, this disclosure provides for a method of loading a multiplex cartridge, the method comprising:

a) providing a cartridge case having a fore end and an aft end, the cartridge case comprising a primer situated at the aft end;

b) loading a propellant adjacent the primer;

c) loading an obturating component adjacent the propellant and a first payload adjacent the obturating component; and d) loading a separating component adjacent the first payload and a second payload adjacent the separating component.

The cartridge can be subsequently crimped following the loading. If additional payload or projectile is desired, a second separating component adjacent the second payload can be loaded, and a third payload adjacent the second separating component subsequently loaded.

Pre-formed gas seals that can be used as obturating components and optionally as separating components are not limited to a particular material, and the material is selected for its properties of obturating performance, thickness, strength, stiffness, ease of fabrication, and so forth. If the multiplex load is intended to be used in a handgun or rifle/carbine having a rifled barrel, it is desirable that the pre-formed gas seal have suitable stiffness and thickness so as not to permanently deform on firing, but also have relatively thin and flexible leading and aft edges ("lips"), so as not to engage the rifling to a substantial degree. Suitable pre-formed gas seals are commercially available, and are made of a suitable plastic or polymer known in the art. One example of a pre-formed gas seal that works well is the Remington Arms Company "H-wad", such as the one designed for Remington's .410 buckshot loading. Typically, the pre-formed obturating components are used as separate elements. However, the present cartridge system also can use a separating component or even obturating component that can be attached to one of the payloads, for example, when the forward-most projectile is a single projectile or slug, the separating component can be attached thereto.

FIG. 1 illustrates one embodiment of a shotshell that incorporates the cartridge system according to this disclosure. This figure is intended to be non-limiting and demonstrate a simplified schematic of one way the cartridge system of this disclosure can be loaded and used. Full details of shotshell components such as shotshell hulls, primers, propellants, shot and the like can be found in various handbooks, such as Thomas J. Griffin, ed., *Shotshell Reloading Handbook,* 5$^{th}$ ed., Lyman Publications, Lyman Products Corporation, Middletown, Conn. (2007) and Don Zutz, *Hodgdon Powder Company Shotshell Data Manual,* 1$^{st}$ ed., Hodgden Power Company, Shawnee Mission, Kans. (1996).

In FIG. 1, the arrangement of one embodiment of the multiplex shotshell loading is illustrated in which the obturating component and the separating component are identical "H-wads", having relatively thick bodies and relatively thin lips. The first payload adjacent and forward the obturating component comprises birdshot, and the second payload adjacent and forward the separating component comprises buckshot. However, this figure is by no means limiting, but merely illustrative of one way in which this disclosure provides for new shotshell constructions. For example, the embodiment of FIG. 1 illustrates a shotshell 5 that includes a shotshell case 10 and its brass or head 15, the primer 20, base wad 25, and propellant 30 adjacent to the obturating component 35. As shown in FIG. 1, the obturating component is illustrated to be a first pre-formed gas seal 35. Adjacent and forward of the obturating component 35 is the first payload 40, which is illustrated as birdshot in this figure. Adjacent and forward the first payload 40 is the separating component 45. The separating component is illustrated in FIG. 1 to be a second pre-formed gas seal 45, identical to the first pre-formed gas seal 35. Adjacent and forward of the separating component 45 is the second payload 50, which is illustrated as buckshot in this figure. It is understood that FIG. 1 illustrates one embodiment, which can be altered or adjusted to suit a particular purpose. For example, smaller amounts of the birdshot first payload 40 can be used, such that an additional buckshot pellet can be included in the second payload 50, if desired. Alternatively, larger amounts of the birdshot first payload 40 can be used, such that only a single buckshot pellet is used in the second payload 50, if desired. Other alternative cartridge arrangements such as these can be applied to any of disclosed embodiments.

In the FIG. 1 embodiment, no overwad or over card wad is needed, because the buckshot pellets are aligned in single file within the cartridge, and the cartridge is crimped using a roll crimp, tightly secured against the resistance of the single, forward-most buckshot pellet. This configuration also works well for slug projectiles as well. However, if desired, any type of shell crimping can be used, as understood by one of ordinary skill. For example, a loaded cartridge can be crimped at the forward end with a star- or fold-crimp of any type, for example, a 6- or 8-point star crimp. FIG. 1 is merely illustrative and not intended to be limiting, as any shotshell can be loaded with the cartridge system of this disclosure, using standard procedures known to one of ordinary skill, and as described in the various treatises and handbooks such as those referenced.

While not limiting, the cartridge system of this disclosure is especially advantageous for loading .410 gauge shotshells with duplex loads, including loads for use in self-defense intended for use in firearms having a rifled barrel. While not intending to be bound by theory, it is thought that the present design overcomes the problems associated with firing such loads through a rifled or overbore barrel. It is particularly desirable that the pre-formed gas seal have suitable stiffness and strength to substantially maintain its shape on firing, but also have relatively thin leading and aft edges or "lips" ("skirt"), so as not to engage the rifling at all or to a substantial degree. Because very stiff obturating components are particularly useful for achieving excellent downrange patterns, it is believed that the obturating component should function to seal the expanding gases, without expanding so much as to catch the rifling. In this way, it is thought that the present configuration overcomes and effectively defeats the rifling by not allowing spin or substantial spin to be imparted on the load, thereby providing the excellent patterns.

For example, the disclosed cartridge system is particularly useful when firing a .410 multiplex load through a .45 caliber revolver adapted for .410 shotshells. In this aspect, it is believed that a very stiff pre-formed gas seal with a thin skirt or lips is useful as the obturating component because the skirt or lips expand or deform enough to achieve its obturation function, while not expanding and deforming so much as to be affected by the rifling in the overbore .45 caliber barrel. The thin, deformable lips of the obturating component appear particularly useful for achieving this function, and the stiff, non-formable body of the pre-formed gas seal also prevents the body from deforming, expanding in width, and engaging the rifling. This type of pre-formed gas seal also works well as a separating component, thereby simplifying the manufacturing process by using a single type of gas seal for both obturating and separating components, if desired.

Also while not intending to be theory bound, the separating component is believed to function primarily as a separating means, which maintains its orientation through the barrel and a sufficient distance downrange without substantial spin, such that shot pattern is not adversely disrupted. The preferred gas seal does not contain any crush sections, but rather is a very stiff obturating component, generally comprising hard plastic, thereby ensuring that the body will not be substantially deformed upon firing the cartridge. In this aspect, the preferred gas seal is one that has a gas-sealing skirt that expands no more than is necessary to achieve its obturating function, such that the body is not substantially deformed upon firing. There are countless variations and combinations of the structures of the disclosed shotshell components, and this disclosure anticipates that any combination or feature of one component can be selected for use with any other particular feature in another component.

In accordance with another aspect, there is provided a multiplex cartridge according to this disclosure, wherein at least one of the first payload and the second payload comprises at least one lead-containing or at least one lead-free projectile. For example, in some aspects and embodiments, at least one of the first payload or the second payload comprises at least one projectile, the projectile comprising lead, steel, bismuth, tungsten, tin, iron, copper, zinc, aluminum, nickel, chromium, molybdenum, cobalt, manganese, antimony, alloys thereof, composites thereof, or any combinations thereof.

Supporting aspects of this disclosure are found, for example, in the following publications, each of which is incorporated herein by reference in its entirety: Thomas J. Griffin, ed., *Shotshell Reloading Handbook,* 5th ed., Lyman Publications, Lyman Products Corporation, Middletown, Conn. (2007); Don Zutz, *Hodgdon Powder Company Shotshell Data Manual,* 1st ed., Hodgden Power Company, Shawnee Mission, Kans. (1996); Bob Brister, *Shotgunning: The Art and the Science*, Winchester Press, New Win Publishing, Inc., Clinton, N.J. (1976); and U.S. Patent Application Publication Number 2011/0017090. Thus, shotshell cartridges according to this disclosure can employ standard shotshell components and loading methods for their construction. By way of example, the shotshell cases or hulls, primers, propellant or powder, shot or other projectiles such as slugs, gas seals, and the like, have all been described in abundant detail in these cited references.

Any variety of solid projectile types, shapes, and number can be loaded into a cartridge such as a shotshell using the cartridge system disclosed herein. For example, all sizes of lead, lead-containing, lead-free, frangible, penetrating, and other projectiles can be employed, including all sizes of birdshot, buckshot, and slug projectiles. Any combination or mixture of shot sizes can be advantageously loaded using cartridge system as provided herein.

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

Reference to the forward end or fore end of a particular component or cartridge means the end that is further downrange when the component or cartridge is in its intended orientation for firing. The fore end may also be termed the leading end or leading edge, the top, the downrange end, the distal end, or the crimp end, and these terms are used interchangeably.

Reference to the rearward or rear end of a particular component or cartridge means the end that is further uprange when the component or cartridge is in its intended orientation for firing. The rear end may also be termed trailing end or trailing edge, the aft portion or aft end, the bottom, the uprange end, the proximal end, the primer end, or the brass end, and these terms are used interchangeably.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A multiplex cartridge comprising:

a) a cartridge case having a fore end and an aft end, the cartridge case comprising a primer situated at the aft end;

b) a propellant adjacent the primer;

c) an obturating component adjacent the propellant and a first payload adjacent the obturating component, wherein the obturating component comprises a preformed gas seal having a deformable skirt and a nondeformable body; and d) a separating component adjacent the first payload and a second payload adjacent the separating component;

wherein the first payload and the second payload comprise projectiles of different sizes.

2. A multiplex cartridge according to claim 1, wherein the obturating component and the separating component are identical pre-formed gas seals.

3. A multiplex cartridge according to claim 1, wherein the pre-formed gas seal has a length-to-width ratio of from about 1 to about 1.4.

4. A multiplex cartridge according to claim 1, wherein the first payload and the second payload comprise projectiles of different composition, hardness, shape, or a combination thereof.

5. A multiplex cartridge according to claim 1, wherein the first payload projectile is smaller than the second payload projectile.

6. A multiplex cartridge according to claim 1, wherein the first payload comprises birdshot and the second payload comprises buckshot.

7. A multiplex cartridge according to claim 1, further comprising a second separating component adjacent the second payload and a third payload adjacent the second separating component.

8. A multiplex cartridge according to claim 1, wherein the cartridge is a .410 gauge cartridge.

9. A multiplex cartridge according to claim 1, wherein the cartridge is a .410 gauge cartridge and the pre-formed gas seal has a length-to-width ratio from about 1 to about 1.4.

10. A multiplex cartridge according to claim 1, wherein the cartridge is a .410 gauge cartridge, the first payload comprises birdshot, and the second payload comprises buckshot.

11. A method of loading a multiplex cartridge comprising:

a) providing a cartridge case having a fore end and an aft end, the cartridge case comprising a primer situated at the aft end;

b) loading a propellant adjacent the primer;

c) loading an obturating component adjacent the propellant and a first payload adjacent the obturating component, wherein the obturating component comprises a pre-formed gas seal having a deformable skirt and a non-deformable body; and d) loading a separating component adjacent the first payload and a second payload adjacent the separating component;

wherein the first payload and the second payload comprise projectiles of different sizes.

12. A method of loading a multiplex cartridge according to claim 11, wherein the obturating component and the separating component are identical pre-formed gas seals.

13. A method of loading a multiplex cartridge according to claim 11, wherein the pre-formed gas seal has a length-to-width ratio of from about 1 to about 1.4.

14. A method of loading a multiplex cartridge according to claim 11, wherein the first payload and the second payload comprise projectiles of different composition, hardness, shape, or a combination thereof.

15. A method of loading a multiplex cartridge according to claim 11, wherein the cartridge is a .410 gauge cartridge and the pre-formed gas seal has a length-to-width ratio from about 1 to about 1.4.

16. A method of loading a multiplex cartridge according to claim 11, wherein the cartridge is a .410 gauge cartridge, the first payload comprises birdshot, and the second payload comprises buckshot.

17. A multiplex cartridge comprising:

a) a cartridge case having a fore end and an aft end, the cartridge case comprising a primer situated at the aft end;

b) a propellant adjacent the primer;

c) an obturating component adjacent the propellant and a first payload adjacent the obturating component;

d) a first separating component adjacent the first payload and a second payload adjacent the first separating component; and e) optionally, a second separating component adjacent the second payload and a third payload adjacent the second separating component;

wherein the obturating component comprises a pre-formed gas seal having a deformable skirt and a non-deformable body and a length-to-width ratio of from about 1 to about 1.4.

18. A multiplex cartridge according to claim 1, wherein the axial length of the pre-formed gas seal is from about 45% to about 145% of its width.

19. A method of loading a multiplex cartridge according to claim 11, wherein the axial length of the pre-formed gas seal is from about 45% to about 145% of its width.

* * * * *